US005194015A

United States Patent [19]

Yamamoto et al.

[11] Patent Number: 5,194,015

[45] Date of Patent: Mar. 16, 1993

[54] DEVICE FOR ELECTRICAL CONNECTION BETWEEN PRINTING HEAD AND DRIVE CIRCUIT THEREFOR

[75] Inventors: Tetsuya Yamamoto, Tanashi; Yukihisa Kato, Higashikurume, both of Japan

[73] Assignee: Citizen Watch Co., Ltd., Tokyo, Japan

[21] Appl. No.: 570,466

[22] Filed: Aug. 21, 1990

[30] Foreign Application Priority Data

Aug. 25, 1989 [JP] Japan ..... 1-98426

[51] Int. Cl.[5] ..... H01R 13/00

[52] U.S. Cl. ..... 439/484; 439/492; 400/692; 400/124

[58] Field of Search ..... 439/484, 492, 493, 498, 439/499, 494; 101/93.04, 93.05; 400/124, 352, 692

[56] References Cited

U.S. PATENT DOCUMENTS

| | | | |
|---|---|---|---|
| 3,431,535 | 3/1969 | Munyon | 439/484 |
| 3,601,768 | 8/1971 | Lightner | 439/494 X |
| 3,731,254 | 4/1973 | Key | 439/494 |
| 3,772,776 | 11/1973 | Weisenburger | 439/493 X |
| 4,085,502 | 4/1978 | Ostman et al. | 439/493 X |
| 4,452,542 | 6/1984 | Akazawa | 400/124 X |
| 4,881,911 | 11/1989 | Haddock et al. | 439/484 |
| 4,930,915 | 6/1990 | Kikuchi et al. | 400/692 X |
| 4,992,059 | 2/1991 | King et al. | 439/492 |

FOREIGN PATENT DOCUMENTS

| | | |
|---|---|---|
| 0040283 | 3/1985 | Japan . |
| 0198484 | 9/1987 | Japan . |

*Primary Examiner*—Larry I. Schwartz
*Assistant Examiner*—Khiem Nguyen
*Attorney, Agent, or Firm*—Lowe, Price, LeBlanc & Becker

[57] ABSTRACT

An electrical connection device for a printing head of a dot printer and a drive circuit therefor, which comprises flexible printed circuits easily connectable to solenoids accommodated in the printing head, and a male connector connected to these circuits. The male connector has electrically conductive pins arranged to be detachably engaged with socket terminals of a female connector fixed to a carriage, the socket terminals being connected to the drive circuit through a flat cable. To mount the printing head onto the carriage, the male connector is plugged into the female connector, while the flexible printed circuits and a flexible hook member are received in a receiving section of the carriage. Disconnection of the printing head from the carriage can be easily made by simply releasing the engagement between the two connectors with the use of the hook member. The flat cable well withstands repetitive bending attributable to reciprocal movement of the printing head.

1 Claim, 3 Drawing Sheets

DEVICE FOR ELECTRICAL CONNECTION BETWEEN PRINTING HEAD AND DRIVE CIRCUIT THEREFOR

BACKGROUND OF THE INVENTION

The present invention relates to a device for electrically connecting a printing head of a dot printer and a drive circuit therefor, and more particularly, to an electrical connection device which is excellent in durability against bending attributable to reciprocal movement of the printing head.

A dot printer is conventionally known, which comprises a carriage movable along a platen, a printing head carried by the carriage and having a plurality of solenoids for driving needles, and a drive circuit for the printing head, electrically connected with the solenoids and fixed to a printer body. This printer operates to activate one or more solenoids by the drive circuit while the printing head is reciprocated along the platen, to thereby effect printing onto a printing sheet on the platen by means of the needles. Recently, a flexible printed circuit (FPC) has been generally employed for connecting the printing head and the drive circuit of the printer of this kind. In this case, one end portion of an electrical conductor of the FPC is soldered to a solenoid of the printing head and another end portion thereof is connected to an output terminal of the drive circuit through a connector, for instance. However, according to this device arrangement, there occurs fatigue failure of the FPC, which is subjected to bending during the movement of the printing head and has poor resistance to repetitive bending, after the movement of the printing head is repeated about two million times.

On the other hand, demands on improved reliability and durability of printers have been increased. To satisfy these demands, an electrical connection device of a printing head and a drive circuit therefor has been demanded, which can withstand about 10 million times of movement of the printing head.

SUMMARY OF THE INVENTION

The object of the present invention is to provide a device for electrically connecting a printing head of a dot printer and a drive circuit therefor, which is excellent in durability against bending attributable to movement of the printing head, easily connectable to the printing head, and permits the printing head to be easily mounted on and dismounted from a carriage.

According to the present invention, there is provided an electrical connection device for connecting a printing head, carried by a carriage which is arranged to be movable along a printer body of a dot printer, with a drive circuit for the printing head, fixed to the printer body. The electrical connection device comprises a flexible printed circuit which includes a plurality of conductors each having one end electrically connected to the printing head. The other ends of the conductors of the flexible printed circuit are electrically connected to a first connector member, which is arranged to be removably engaged with a second connector member fixed to the carriage. The second connector member is electrically connected to the drive circuit for the printing head by a flat cable which includes a plurality of conductors.

The present invention is advantageous in that, since the flat cable which can well withstand repetitive bending attributable to movement of the carriage is employed for connecting the second connector member fixed to the carriage movable relative to the printer body and the printing head drive circuit fixed to the printer body, the electrical connection device is excellent in durability. Since the first connector member connected to the printing head by the flexible printed circuit is removably engaged with the second connector member fixed to the carriage, it is easy for the printing head to be mounted on and dismounted from the carriage. Moreover, since the flexible printed circuit easily connectable to the printing head is employed, it is easy to connect the electrical connection device to the printing head. Furthermore, the flexible printed circuit, which is excellent in flexibility and is thin in thickness, can be easily received in a narrow internal space of the carriage.

DETAILED DESCRIPTION

Figure 1:
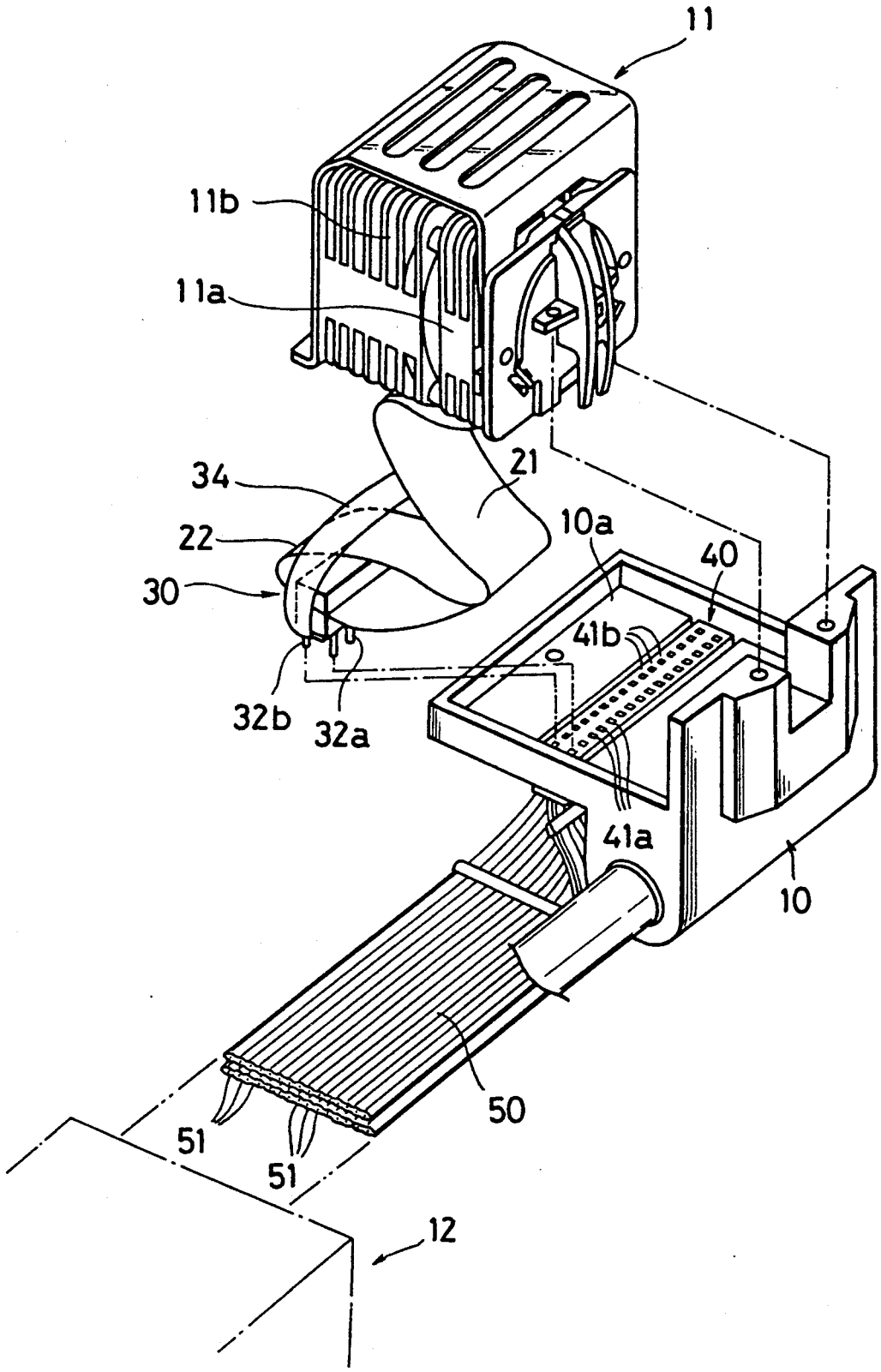
FIG. 1 is an exploded perspective view showing an electrical connection device according to an embodiment of the present invention together with peripheral elements.

Referring to FIG. 1, a dot printer, which is equipped with an electrical connection device of an embodiment of the present invention, comprises a carriage 10 arranged to be movable along a platen (not shown) of the printer, a printing head 11 which is mounted on the carriage to be movable in unison therewith, and a drive circuit 12 for driving the printing head 11. The drive circuit 12 is fixed to a printer body (not shown). An upper face of the carriage 10 cooperates with a bottom face of the printing head 11 to define a section 10*a* for receiving flexible printed circuits, mentioned later. Each of front and rear units 11*a* and 11*b* of the printing head 11 accommodates therein a plurality of solenoids (not shown) for driving needles (not shown) toward the platen. Printed circuit boards (not shown) are respectively disposed in front of the front and rear units 11*a*, 11*b*, and have their terminals electrically connected to corresponding terminals of the solenoids accommodated in these units 11*a*, 11*b*.

Figure 4:
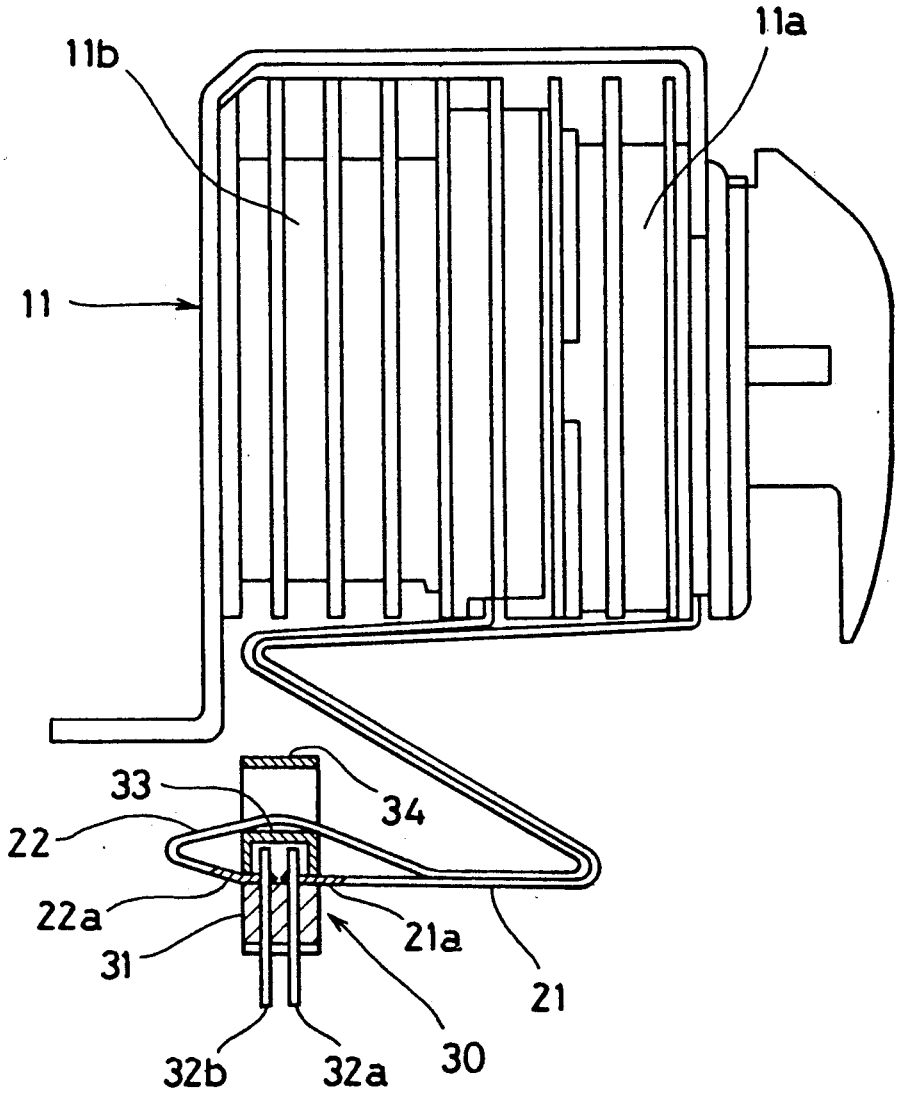
FIG. 4 is a side view, partly shown in cross section, of a printing head and the male connector.

As shown in FIGS. 1 and 4, the electrical connection device for the printing head 11 and the drive circuit 12 has first and second flexible printed circuits (hereinafter referred to as FPCs) 21 and 22 respectively associated with the printing head units 11*a* and 11*b*. Each of the FPCs 21, 22 consists of a base film (not shown), an overlay film (not shown), and a plurality of conductors (one conductor for each FPC is shown by reference numeral 21*a* or 22*a*), e.g., copper foils, interposed between these films and extending in parallel to one another. The respective one ends of the conductors of each FPC are electrically connected to the terminals of the printed circuit board concerned, and hence electrically connected to the corresponding solenoids through the printed circuit board, respectively.

Figure 2:
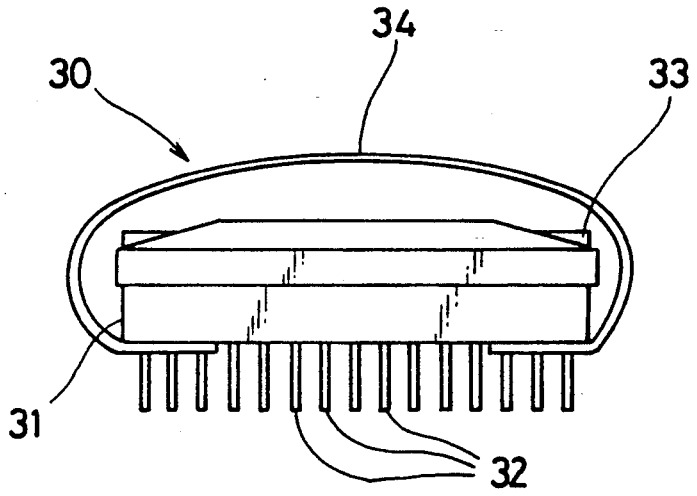
FIG. 2 is a side view showing a male connector of the electrical connection device.
Figure 3:
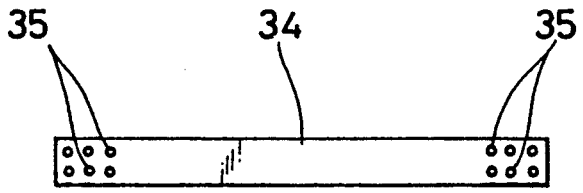
FIG. 3 is a plan view showing a hook member mounted to the male connector.

As shown in FIG. 2, a male connector (first connector member) 30 of the electrical connection device comprises a connector body 31, a plurality of electrically conductive pins 32 extending through the connector body, a cover member 33, and a hook member 34 which permits an operator to easily handle the connector 30. The pins 32 consist of electrically conductive pins 32*a* for the first FPC 21 which are aligned at one side of the connector body 31 and similar pins 32*b* for the second FPC 22 aligned at the other side of the connector body 31. The hook member 34 is comprised of a synthetic resin tape, e.g., a polyester film, which is flexible and has its length longer than the width of the connector body 31. This hook member 34 is disposed in a manner surrounding both outer end faces of the connector body 31 and the outer faces of the cover member 33. The hook member 34 is formed at its each end portion with, e.g., six holes 35 (FIG. 3), and is fixed to the connector body 31 by inserting the corresponding pins 32 into these holes 35. The first FPC 21 extends from the bottom face of the printing head 11 to one side of the male connector 30, and the ends of the conductors of the FPC 21 at the side close to the connector are respectively soldered to the corresponding ones of the electrically conductive pins 32*a*. The second FPC 22 extends from the bottom face of the printing head to between the cover member 33 and the hook member 34, and further extends to the other side of the connector 30, and the ends of the conductors of the FPC 22 at the side close to the connector are soldered to the corresponding ones of the pins 32*b*, respectively. The connection nodes of the FPCs 21, 22 and the pins 32 are covered by the cover member 33. The connector body 31 has its width which is the same as those of the FPCs 21, 22.

The electrical connection device further comprises a female connector (second connector member) 40 embedded in the carriage 11, and a flat cable 50. The female connector 40 has socket terminals 41*a* and 41*b* which respectively correspond to the conductive pins 32*a* and 32*b* of the male connector 30, these pins being arranged to be removably engaged with the socket terminals. Namely, the male connector 30 is arranged to be removably attached to the female connector 40. The flat cable 50 has a plurality of conductors 51 embedded in synthetic resin and each having one end thereof electrically connected to a corresponding one of the socket terminals 41*a* and 41*b* of the female connector 40. The other ends of the conductors 51 are respectively connected to corresponding solenoid driving current output terminals (not shown) of the drive circuit 12 for the printing head.

Upon assemblage of the electrical connection device constructed as mentioned above, at first, the respective one ends of the conductors of the FPC 21 and 22 are connected to the printed circuit boards to which the solenoids of the printing head 11 are connected. Since the FPCs 21 and 22 are thin in thickness and flexible, it is easy to connect the FPCs 21, 22 to the printed circuit boards. Then, the respective other ends of the conductors of the first FPC 21 are connected to the conductive pins 32*a* of the male connector 30, and the second FPC 22 are connected to the conductive pins 32*b*. Further, the cover member 33 kept interposed between the first and second FPCs 21 and 22 is fixed to the connector body 31, to thereby cover the connection nodes between the FPCs 21, 22 and the conductive pins 32. After the holes formed in one end portion of the hook member 34 are respectively engaged with the pins 32 provided in the corresponding end portion of the connector 30, the hook member 34 is disposed so that it surrounds the cover member 33 and the second FPC 22, and then the holes formed in the other end portion of the hook member 34 are engaged with the pins 32 provided at the corresponding end portion of the connector 30, whereby the hook member 34 is fixed to the connector body 31. Subsequently, the opposite ends of the conductors 51 of the flat cable 50 are connected to the output terminals of the drive circuit 12 and the socket terminals 41*a*, 41*b*, respectively, and then the connector 40 is fixedly mounted on the carriage 10. Whereupon, the conductive pins 32*a* and 32*b* of the male connector 30 are respectively inserted into the socket terminals 41*a* and 41*b* of the female connector 40, to thereby mount the connector 30 to the connector 40. Finally, the printing head 11 is placed on and fixed to the carriage 10, while the FPCs 21, 22 and the hook member 34 are received in the receiving section 10*a* of the carriage 10. When these elements 21, 22 and 34 are received in the section 10*a*, the FPCs 21 and 22 which are thin and flexible are folded and the hook member 34 having similar properties is deformed, and hence no substantial difficulties are encountered even if the receiving section 10*a* is small in capacity. Consequently, the flexible elements 21 and 22 can be collapsibly stored within section 10*a* of the carriage 10.

When the printer is in use, the driving currents supplied from the output terminals of the drive circuit 12 for the printing head are applied to desired ones of the solenoids accommodated in the printing head 11, through the flat cable 50, female connector 40, male connector 30, first and second FPCs 21, 22 and printed circuit boards, whereby associated needles are operated for printing. During the printing operation, the carriage 10 and the printing head 11 are reciprocated along the platen. As a result, the flat cable 50 connecting the female connector 40, which moves in unison with the carriage 10, and the drive circuit 12 fixed to the printer body is subjected to repetitive bending. At this time, the flat cable 50 consisting of the synthetic resin and the conductors embedded therein can well withstand the repetitive bending. Thus, the conductors of the flat cable 50 cannot be broken even after the printer has been employed for a considerably long time period. Namely, the electrical connection device is excellent in durability.

Upon maintenance or replacement of the printing head 11, an operator hooks his finger to the hook member 34 of the male connector 30 received in the receiving section 10*a* of the carriage 10 and pulls it, to thereby pull out the male connector 30 from the female connector 40. The male connector 30 can be easily detached from the female connector 40 because of the provision of the hook member 34. Further, it is unnecessary for the operator to pull the FPCs 21 and 22 for the disconnection of the connector 30, whereby the FPCs 21, 22 can be prevented from being broken. In addition, the printing head 11 can be dismounted from the carriage by simply removing the male connector 30 from the female connector 40, without the need of removing the other elements 40 and 50 of the electrical connection device from the printer.

What is claimed is:

1. An electrical connection device for connecting a printing head, carried by a carriage arranged to be movable along a printer body of a dot printer, with a drive circuit for the printing head, fixed to the printer body, said electrical connection device comprising:

a flexible printed circuit including a plurality of conductors each having one end electrically connected to the printing head;

a first connector member electrically connected to the other ends of said plurality of conductors of said flexible printed circuit, said first connector member comprising a male connector having a plurality of electrically conductive pins respectively connected to said plurality of conductors of said flexible printed circuit, said male connector having a body supporting said plurality of electrically conductive pins, which are also connected to the conductors of said printed circuit inside a cover member of the connector body;

a second connector member disposed within and fixed to a section of the carriage such that the flexible printed circuit can be collapsibly stored within said section of the carriage, said first connector member being arranged to be removably engaged with said second connector member, said second connector member comprising a female connector having a plurality of socket terminals;

a flat cable including a plurality of conductors and electrically connecting said second connector member to said drive circuit for the printer head, wherein the plurality of socket terminals connect to said plurality of conductors of said flat cable; and a flexible hook member which extends along a face of said connector body at a side thereof remote from said plurality of electrically conductive pins, said hook member having opposite end portions thereof formed with holes through which are inserted corresponding ones of said plurality of electrically conductive pins which are disposed at opposite end portions of said connector body, to thereby fix said hook member to said connector body.

* * * * *